United States Patent [19]

Barrette

[11] 4,082,182

[45] Apr. 4, 1978

[54] MATCHBOOK COVERS

[75] Inventor: Richard P. Barrette, Lancaster, Mass.

[73] Assignee: Automated Molding Corporation, Westboro, Mass.

[21] Appl. No.: 752,401

[22] Filed: Dec. 20, 1976

[51] Int. Cl.[2] ..... A24F 27/00

[52] U.S. Cl. ..... 206/107; 206/108; 206/114

[58] Field of Search ..... 206/91–92, 206/106–108, 110, 114, 118, 259

[56] References Cited

U.S. PATENT DOCUMENTS

| | | | |
|---|---|---|---|
| 1,196,002 | 8/1916 | Leo | 206/110 |
| 1,362,371 | 12/1920 | Thomae | 206/107 |
| 2,288,343 | 6/1942 | Brooks | 206/107 |
| 2,311,072 | 2/1943 | Musson | 206/110 |
| 2,329,175 | 9/1943 | Gits | 206/107 |

*Primary Examiner*—Steven E. Lipman

[57] ABSTRACT

An organic plastic matchbook cover having continuous front, back and side walls, and that is closed at its bottom and generally open at its top. The walls and bottom define a generally wedge-shaped interior cavity having the size and shape necessary to receive a conventional paper matchbook therewithin. An opening is provided in the front wall of the cover in position to overlie the striking surface of the matchbook, and a second opening is provided in the back wall to permit a thumb or finger to engage the back of the matchbook. A holding tab projects from the top of the back wall partially across the top of the cover towards the front wall in position to overlie and engage the top of a matchbook positioned in the cavity, and a locking tab projects inwardly from each of the side walls.

9 Claims, 6 Drawing Figures

FIG 1
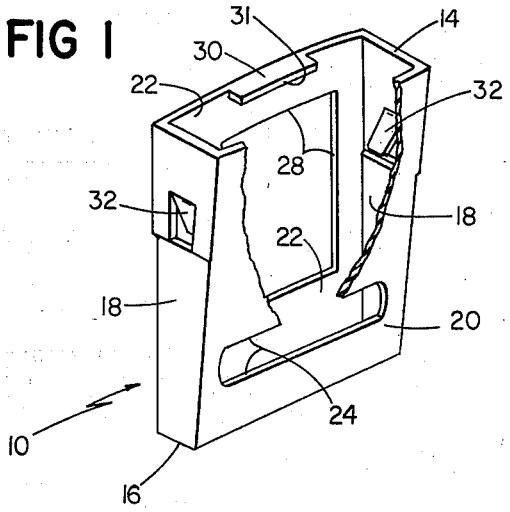
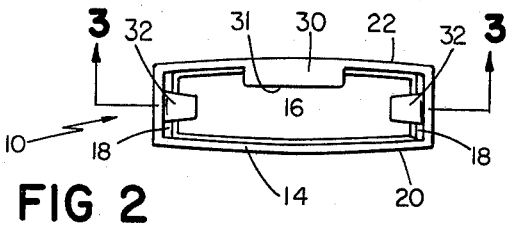
FIG 2
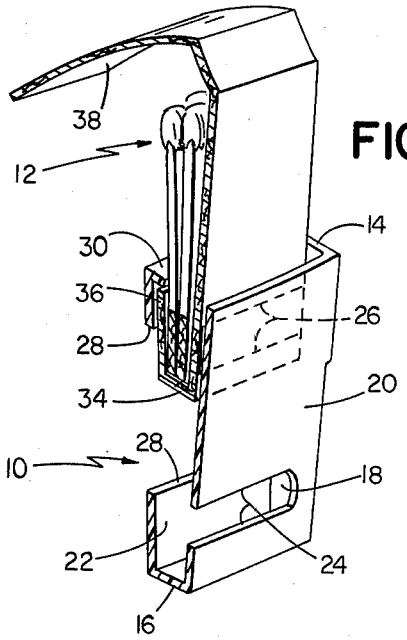
FIG 4
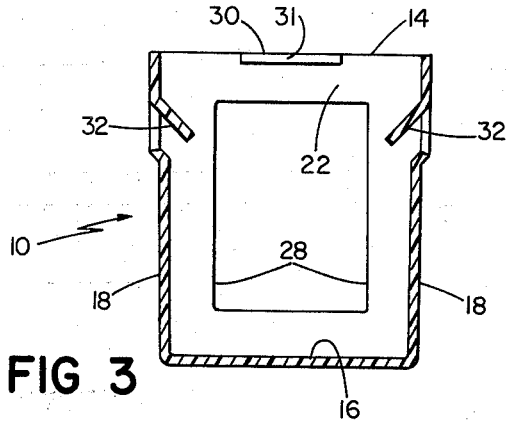
FIG 3
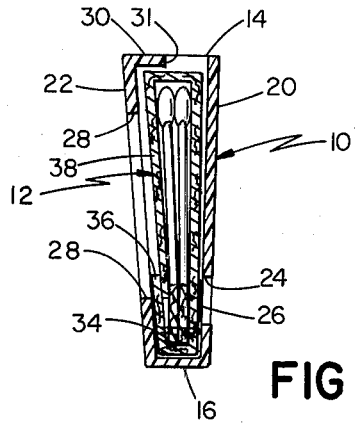
FIG 5
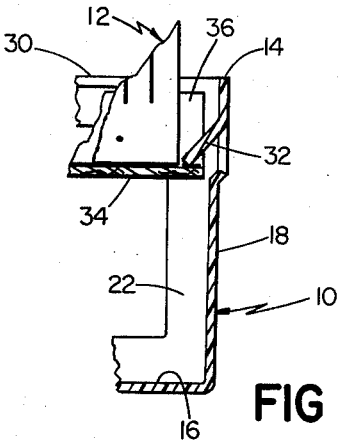
FIG 6

MATCHBOOK COVERS

This invention relates to matchbook covers.

Each year, many children injure themselves or start fires while playing with or otherwise misusing common paper matches. Most such injuries and fires could be prevented if matchbooks were so designed that they could not easily be opened by children under five or six years of age. Recently, many groups such as the American Society for Testing and Materials and the United States Consumer Products Commission have proposed standards requiring that matchbooks sold in the United States be "child-proof". One proposed method for achieving this goal requires strengthening and redesigning the paperboard or other material wrapped around the match comb so that, when it is closed and latched in place, opening requires two or more simultaneous motions, two or more sequential motions, or an opening force in excess of 5 lbs. To manufacture such a strong matchbook would require major modifications in the design of, and in equipment now used to manufacture, conventional paper matchbooks. It would also be somewhat wasteful since the strengthened material, probably plastic or metal, would form an integral part of the matchbook and be thrown away when all the matches had been used.

It is a principal object of the present invention to provide an effective child-proof cover that can be used with conventional matchbooks. Other objects include providing such covers that require simultaneous motions in more than one direction to permit opening of a matchbook within the cover, can quickly and easily be closed, which prevent a match from being struck unless closed, which are relatively inexpensive to make and, preferably, reusable, and which do not adversely affect the important advertising function of conventional matchbooks.

The invention features an organic plastic matchbook cover having continuous front, back and side walls, and that is closed at its bottom and generally open at its top. The walls and bottom define a generally wedge-shaped interior cavity having the size and shape necessary to receive a conventional paper matchbook therewithin. An opening is provided in the front wall of the cover in position to overlie the striking surface of the matchbook, and a second opening is provided in the back wall to permit a thumb or finger to engage the back of the matchbook. A holding tab projects from the top of the back wall partially across the top of the cover towards the front wall in position to overlie and engage the top of a matchbook positioned in the cavity, and a locking tab projects inwardly from each of the side walls. In preferred embodiments, the cover comprises a single piece of molded, optically transparent, organic plastic, typically polystyrene, and the front and back walls are bowed slightly outwardly.

Other objects, features and advantages will appear from the following detailed description of a preferred embodiment of the invention, taken together with the attached drawings in which:

FIG. 1 is a perspective view of a matchbook cover constructed in accord with the present invention;

FIG. 2 is a top view of the matchbook cover of FIG. 1;

FIG. 3 is a sectional view taken at line 3—3 of FIG. 2;

FIGS. 4 and 5 are sectional views illustrating a matchbook positioned, respectively, partially and wholly within the cover; and, FIG. 6 is a partial sectional view illustrating a portion of the matchbook and cover in the partially withdrawn position of FIG. 4.

Referring more particularly to the drawings, there is shown a matchbook cover, generally designated 10, in which is placed a conventional paper matchbook, generally designated 12. Cover 10 comprises an integral piece of molded organic plastic, typically clear polystyrene or polycarbonate, is generally open at its top 14 and closed at its bottom 16, and has a pair of generally parallel side walls 18 and a pair of upwardly diverging front and back walls 20, 22, respectively. The interior of cover 10 thus defines a generally wedge-shaped cavity of size and shape to receive conventional paper matchbook 12.

The upper portions of front wall 20 and back wall 22 are, as shown in FIG. 2, slightly outwardly convex. A striker opening 24 is provided in the lower portion of front wall 20. Opening 24 is of size substantially equal to, and is positioned to overlie, the friction, i.e. the dried chemical striking surface 26, of matchbook 12. Back wall 22 defines a finger opening 28 about 1 $\frac{1}{4}$ inches high (about $\frac{2}{3}$ the 2 inch overall height of cover 10 and matchbook 12) and a little less than 1 in. wide (about $\frac{2}{3}$ the width of the cover and matchbook).

A holding tab 30 projects inwardly from the top of back wall 22, partially across the open top of cover 10 toward front wall 20. As shown, tab 30 is centered on back wall 22, extends about $\frac{1}{3}$ the side-to-side width of cover 10, and projects about $\frac{1}{8}$ inch, a little less than $\frac{1}{4}$ the distance between the tops of front and back walls 20, 22.

To prevent a matchbook from being withdrawn from cover 10, a retaining lug 32 projects inwardly from the center of each of side walls 18; about one-half inch below the top 14 of cover 10. As shown most clearly in FIGS. 1 and 3, each lug 32 comprises a spring finger, about $\frac{1}{4}$ inch long, projecting downwardly and inwardly from a respective one of side walls 18 at an angle of 30°–45° from the vertical. Lugs 32 are designed to flex back towards side walls 18 to permit a matchbook 12 to be inserted into cover 10; and, as shown in FIG. 6, then to snap back into position for engaging the fold 34 at the matchbook bottom to prevent the matchbook from being completely withdrawn from the cover. The distance of lugs 32 from the top of cover 10 is designed to permit matchbook 12 to be moved to the partially withdrawn position, shown in FIG. 4, in which the top of matchbook closure tab 36 is slightly below tab 30, and the matchbook flap 38 may be opened and a match 34 torn from book 12.

In use, a closed matchbook 12 is placed in cover 10 simply by inserting it, bottom end fold 34 first with striker surface 26 adjacent front wall 20, into the open top of cover 10. Lugs 32 flex outwardly to permit matchbook 12 to be inserted fully into cover 10, and then snap back into place.

When fully inserted into cover 10, in the relative position as shown in FIG. 5, striking surface 26 is aligned with opening 24 in cover front wall 20, and holding tab 30 projects partially over the matchbook top. It is not possible to remove a match from matchbook 12 when the matchbook is in this position. Because cover 10 is transparent, all the advertising normally found on the outside of the matchbook can still be read.

When a person wants a match, it is necesssary partially to remove matchbook 12 from cover 10, i.e., to move it to the position shown in FIG. 4, so that the matchbook can be opened. This is done by squeezing the tops of cover side walls 18 together, thereby flexing walls 20, 22 more outwardly so that there is room for matchbook 12 to pass between the inner edge 31 of holding tab 30 and front wall 20, and simultaneously engaging the back of matchbook 12 through opening 28 in cover back wall 22 and pushing the matchbook upwardly. Unless these two motions are performed simultaneously, tab 30 will prevent matchbook 12 from being withdrawn from the cover.

When matchbook 12 has been moved upwardly relative to cover 10 to the position shown in FIG. 4, bottom fold 34 will come into engagement with lugs 32 and prevent further relative movement. The matchbook cannot be completely withdrawn from cover 10 without either breaking lugs 32 or tearing fold 34, both of which would require more force than a small child would be able to exert.

In the position shown in FIG. 4, it is possible to open matchbook 12 and remove a match therefrom. It is not possible, however, to strike the match since striking surface 26 is covered by a solid portion of wall 20. To strike the match, matchbook 12 must be closed and then pushed all the way back into cover 10.

Other embodiments will be within the scope of the following claims.

What is claimed is:

1. In a matchbook cover comprising continuous front, back and side walls defining a generally wedge-shaped interior cavity closed at its bottom and generally open at its top and of size and shape to receive a matchbook therewithin, that improvement wherein:

a holding tab projects from the top of said back wall partially over the top of said cavity towards said front wall in position to partially overlie the top of a matchbook in said cavity and retain and prevent withdrawal of said matchbook from said cavity until said back and front walls are flexed outwardly in response to force applied to said side walls to increase the distance between said front wall and the adjacent edge of said tab to permit such withdrawal;

a striker opening is provided in said front wall adjacent the bottom thereof in position to overlie the striking surface of a matchbook positioned wholly within said cavity;

a finger opening is provided in the central portion of said back wall; and, cover portions project inwardly from each of said side walls in position for engaging bottom portions of matchbook positioned partially within said cavity to prevent the matchbook from being removed from the cavity without at least partially destroying the cover portions of the matchbook bottom portions.

2. The matchbook cover of claim 1 wherein the portions of said front and back walls adjacent the top of said cover are outwardly convex.

3. The matchbook cover of claim 1 wherein said cover comprises a unitary piece of molded optically transparent organic plastic.

4. The matchbook cover of claim 3 wherein said cover is of molded polystyrene or polycarbonate.

5. The matchbook cover of claim 1 wherein said cover portions comprise a finger projecting inwardly and downwardly from each of said side walls at an angle in the range of 30° to 45° from the vertical, each of said fingers being located in the upper-third of said cover.

6. The matchbook cover of claim 5 wherein said fingers are flexible towards said side walls.

7. The matchbook cover of claim 1 wherein said finger opening extends about $\frac{2}{3}$ the overall height of said cover and has a width of not less than about 1 inch.

8. The matchbook cover of claim 1 wherein said holding tab projects in the range of a little less than $\frac{1}{4}$ to more than $\frac{1}{2}$ the distance from the top of said back wall to the top of said front wall.

9. The matchbook cover of claim 8 wherein said holding tab is centered on said back wall, extends about $\frac{1}{3}$ the side wall to side wall width of said cover, and projects about $\frac{1}{4}$ said distance.

* * * * *